US010722036B2

(12) United States Patent
Chang

(10) Patent No.: US 10,722,036 B2
(45) Date of Patent: Jul. 28, 2020

(54) SADDLE CHAIR

(71) Applicant: Chin-Chia Chang, Kaohsiung (TW)

(72) Inventor: Chin-Chia Chang, Kaohsiung (TW)

( * ) Notice: Subject to any disclaimer, the term of this patent is extended or adjusted under 35 U.S.C. 154(b) by 35 days.

(21) Appl. No.: 16/223,524

(22) Filed: Dec. 18, 2018

(65) Prior Publication Data

US 2020/0187659 A1 Jun. 18, 2020

(51) Int. Cl.
*A47C 3/18* (2006.01)
*A47C 7/02* (2006.01)
*A47C 9/02* (2006.01)

(52) U.S. Cl.
CPC ..... *A47C 7/029* (2018.08); *A47C 9/025* (2013.01)

(58) Field of Classification Search
CPC .. A47C 7/029; A47C 7/16; A47C 7/14; A47C 7/46; A47C 5/12
USPC ..... 297/452.21
See application file for complete search history.

(56) References Cited

U.S. PATENT DOCUMENTS 6,158,806 A * 12/2000 White ..... B62J 1/007 297/195.1
6,319,585 B1 * 11/2001 Coronado ..... A47C 5/14 428/106
8,317,267 B2 * 11/2012 Wallace ..... A47C 7/029 297/423.12
8,544,943 B2 * 10/2013 Fields ..... A47C 1/11 297/188.01
9,421,139 B2 * 8/2016 Wilson ..... A61G 5/14
10,165,862 B2 * 1/2019 Schmitz ..... A47C 9/02
2003/0218370 A1 * 11/2003 Langham ..... A47C 3/18 297/344.22
2011/0012397 A1 * 1/2011 Wallace ..... A47C 7/029 297/195.11

* cited by examiner

*Primary Examiner* — Shin H Kim
(74) *Attorney, Agent, or Firm* — Alan D. Kamrath; Mayer & Williams PC

(57) ABSTRACT

A saddle chair contains: a first seat and a second seat. The first seat includes a first connection sheet and an elongated orifice. The second seat includes a second connection sheet and a through orifice. A fixing member includes a slide slot having a slidable face, a receiving orifice, and a chute. A drive member is connected with a retainer via the receiving orifice, the elongated orifice, and the through orifice. The retainer includes a contacting face. Two screw bolts are screwed with the drive member via the retainer. A control bolt is screwed with a threaded orifice of the drive member and includes at least one recess on which at least one engagement block is fitted. Each engagement block has a screw and a forcing edge sliding between the slidable face and the chute, when the control bolt is rotated to move along the threaded orifice.

3 Claims, 8 Drawing Sheets

SADDLE CHAIR

BACKGROUND OF THE INVENTION

Field of the Invention

The present invention relates to a saddle chair which contains a first seat and a second seat both retained by using a fixing member and a retainer.

Description of the Prior Art

A conventional saddle chair P2 contains: a first seat P21, a second seat P22, a connector P23, a fixing member P24, two engagement blocks P25, and a control bolt P26.

The first seat P21 includes a first connection sheet P210 extending from a bottom thereof and an elongated orifice P211 defined on the first connection sheet P210.

The second seat P22 includes a second connection sheet P221 extending from a bottom thereof and a through orifice P222 defined on the second connection sheet P221.

The connector P23 includes a flat face P233 formed on a top thereof, an arcuate section P231 extending to a center of the top of the connector P23 from the flat face P233, and a receiving orifice P232 defined on a center of the arcuate section P231.

The fixing member P24 is cylindrical and is accommodated in the receiving orifice P232 of the connector P2, wherein the fixing member P24 includes a threaded orifice P241 arranged perpendicular to the fixing member P24.

Each of the two engagement blocks P25 includes a passing orifice P251 defined on a center thereof, a plane section P252, and a tilted section P253.

The control bolt P26 includes a screwing section P262. In assembly, the connector P23 is fixed onto the elongated orifice P211 of the first connection sheet P210 of the first seat P21 so that the fixing member P24 is fitted with a nut P27 via the receiving orifice P232 of the connector P23, the elongated orifice P211 of the first seat P21, and the through orifice P222 of the second seat P22, and the fixing member P24 is welded with the second seat P22, such that the fixing member P24, the connector P23, the first seat P21, and the second seat P22 are connected, wherein the screwing section P262 of the control bolt P26 is inserted through a passing orifice P251 of one of the two engagement block P25, the threaded orifice P241 of the fixing member P24, and a passing orifice P251 of the other engagement block P25 to connect with the two engagement blocks P25 by using two screws P28 respectively so that the control bolt P26, the two engagement blocks P25, and the fixing member P24 are connected, as illustrated in FIGS. 1 and 2.

When the control bolt P26 is rotated tightly, the two plane sections P252 of the two engagement blocks P25 abut against the flat face P233 of the connector P23 so that the connector P23 forces the first connection sheet P210 of the first seat P21 and the second connection sheet P221 of the second seat P22.

When the control bolt P26 is rotated loosely to move forward, the two engagement blocks P25 are driven by the control bolt P26 to move forward so that the two plane sections P252 of the two engagement blocks P25 remove from the flat face P233 of the connector P23, and two tilted section P253 of the two engagement blocks P25 move onto the flat face P233 of the connector P23, such that a gap produces among the two engagement blocks P25 and the flat face P233 of the connector P23, and the first connection sheet P210 of the first seat P21 and the second connection sheet P221 of the second seat P22 are not forced by the connector P23 so that the first seat P21 is moved leftward and rightward to adjust its angle. When the first seat P21 is moved leftward and rightward, the elongated orifice P211 of the first seat P21 mates with the fixing member P24 to limit a moving distance of the first seat P21. When the left seat P21 and the second seat P22 are adjusted to a desired position, the control bolt P26 is rotated tightly to drive the first seat P21 and the second seat P22 to move rearward and to actuate the two plane sections P252 of the two engagement blocks P25 to force the plane section P233 of the connector P23, hence the connector P23 forces the first connection sheet P210 of the first seat P21 and the second connection sheet P221 of the second seat P22, thus fixing the first seat P21 and the second seat P22 to the desired position, as shown in FIGS. 2 and 3.

However, the connector P23 is a disc and has a tolerance precision and cannot orientate the two engagement blocks P25 and the second seat P21, so after the two engagement blocks P25 are abraded, they cannot engage with the second seat P21, thus causing a removal of the second seat P21 to injure a user. Furthermore, the user falls off from the saddle chair P2 to cause using danger.

The present invention has arisen to mitigate and/or obviate the afore-described disadvantages.

SUMMARY OF THE INVENTION

The primary objective of the present invention is to provide a saddle chair which contains a first seat and a second seat both retained by using a fixing member and a retainer.

To obtain above-mentioned object, a saddle chair provided by the present invention contains: a first seat and a second seat.

The first seat includes a first connection sheet connected with a bottom of the first seat and an elongated orifice defined on the first connection sheet.

The second seat includes a second connection sheet connected with a bottom of the second seat and a through orifice defined on the second connection sheet.

A fixing member is mounted on the first connection sheet, and the fixing member includes a slide slot defined on a top thereof and having a slidable face formed on a bottom of the slide slot, a receiving orifice defined on a center of the slidable face, and a chute extending downward from the slidable face.

A drive member is inserted through the receiving orifice, the elongated orifice and the through orifice to connect with a retainer which is connected with a bottom of the second connection sheet.

The retainer includes a contacting face formed on a top thereof and contacting with the bottom of the second connection sheet.

Two screw bolts are inserted through the retainer upward to screw with a bottom of the drive member.

A control bolt is screwed with a threaded orifice of the drive member and includes at least one recess defined on the control bolt.

At least one engagement block is fitted on the at least one recess of the control bolt respectively, and each of the at least one engagement block includes a screw inserted into each of the at least one recess and received in the slide slot, wherein each engagement block further includes a forcing edge formed on a bottom thereof and sliding between the slidable face and the chute, when the control bolt is rotated to move along the threaded orifice.

Preferably, the chute corresponds to a front side of the drive member and has a tilted face defined on a front end of the chute and extending reward to the receiving orifice. The control bolt has two recesses corresponding to the front side and a rear side of the drive member respectively, and when two engagement blocks are fitted into the two recesses of the control bolt individually, two pressing faces on two bottoms of the two engagement blocks are tilted respectively, wherein two front sides of the two pressing faces are higher than two rear sides of the two pressing faces individually, and two forcing edges are formed on the two rear sides of the two pressing faces respectively.

Preferably, the drive member further includes two threaded orifices defined in a bottom thereof, and the retainer further includes two coupling orifices defined thereon and corresponding to the two threaded orifices respectively, wherein the two screw bolts are inserted through the coupling orifices of the retainer upward to screw with the two threaded orifices of the drive member respectively, thus fixing the retainer on the bottom of the drive member.

DETAILED DESCRIPTION OF THE PREFERRED EMBODIMENTS

Figure 1:
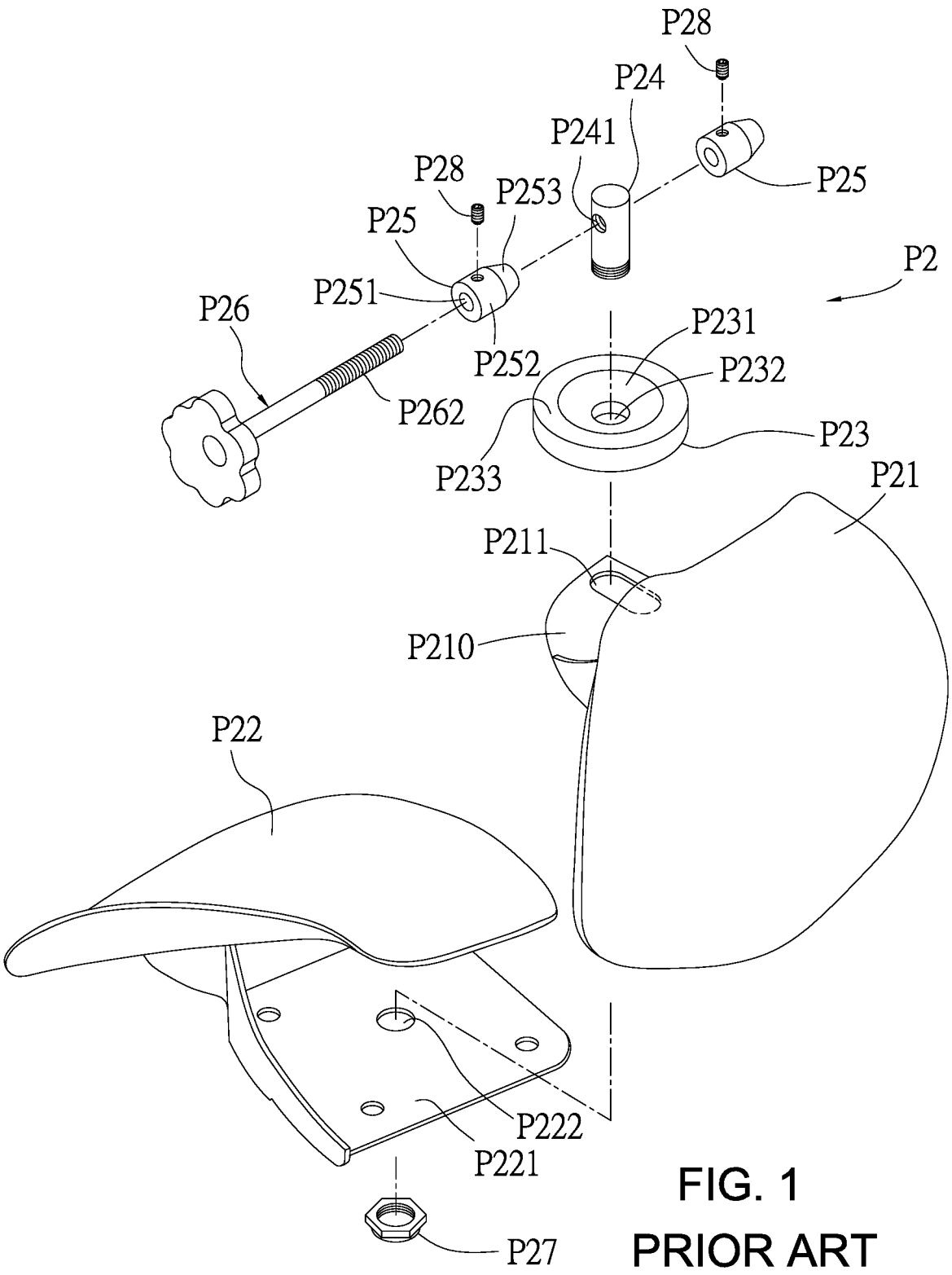
FIG. 1 PRIOR ART
FIG. 1 is a perspective view showing the exploded components of a conventional saddle chair.
Figure 2:
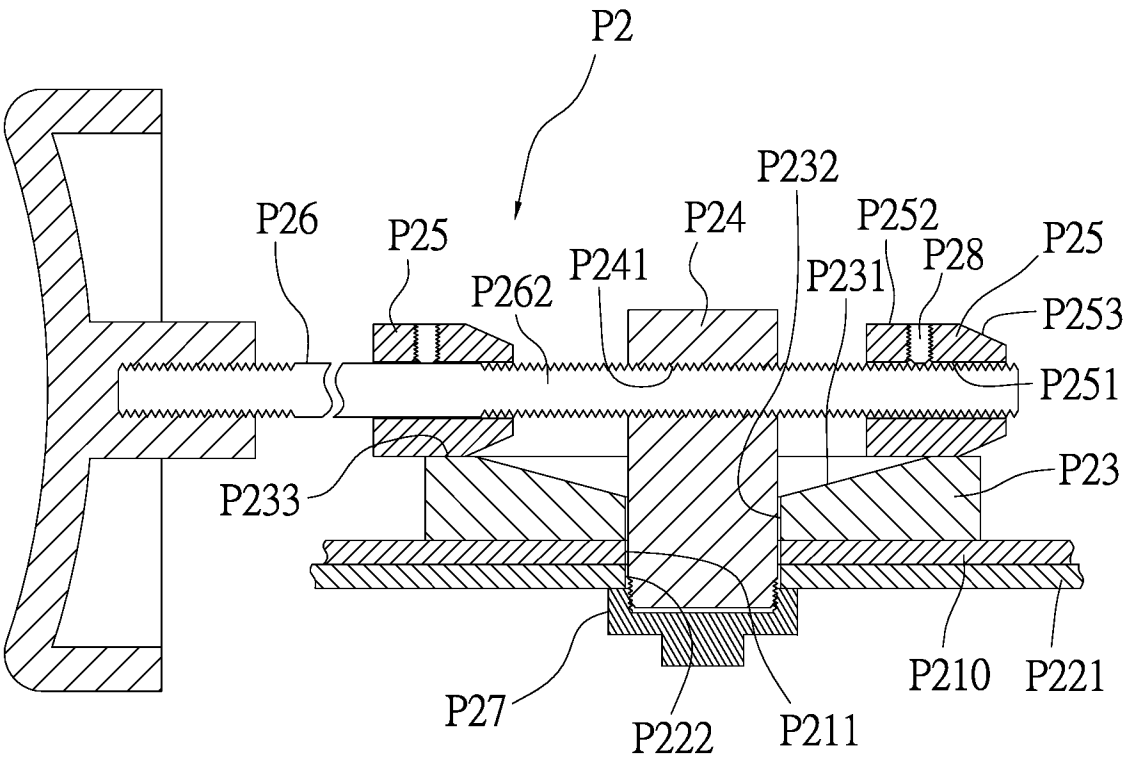
FIG. 2 PRIOR ART
FIG. 2 is a cross sectional view showing the assembly of the conventional saddle chair.
Figure 3:
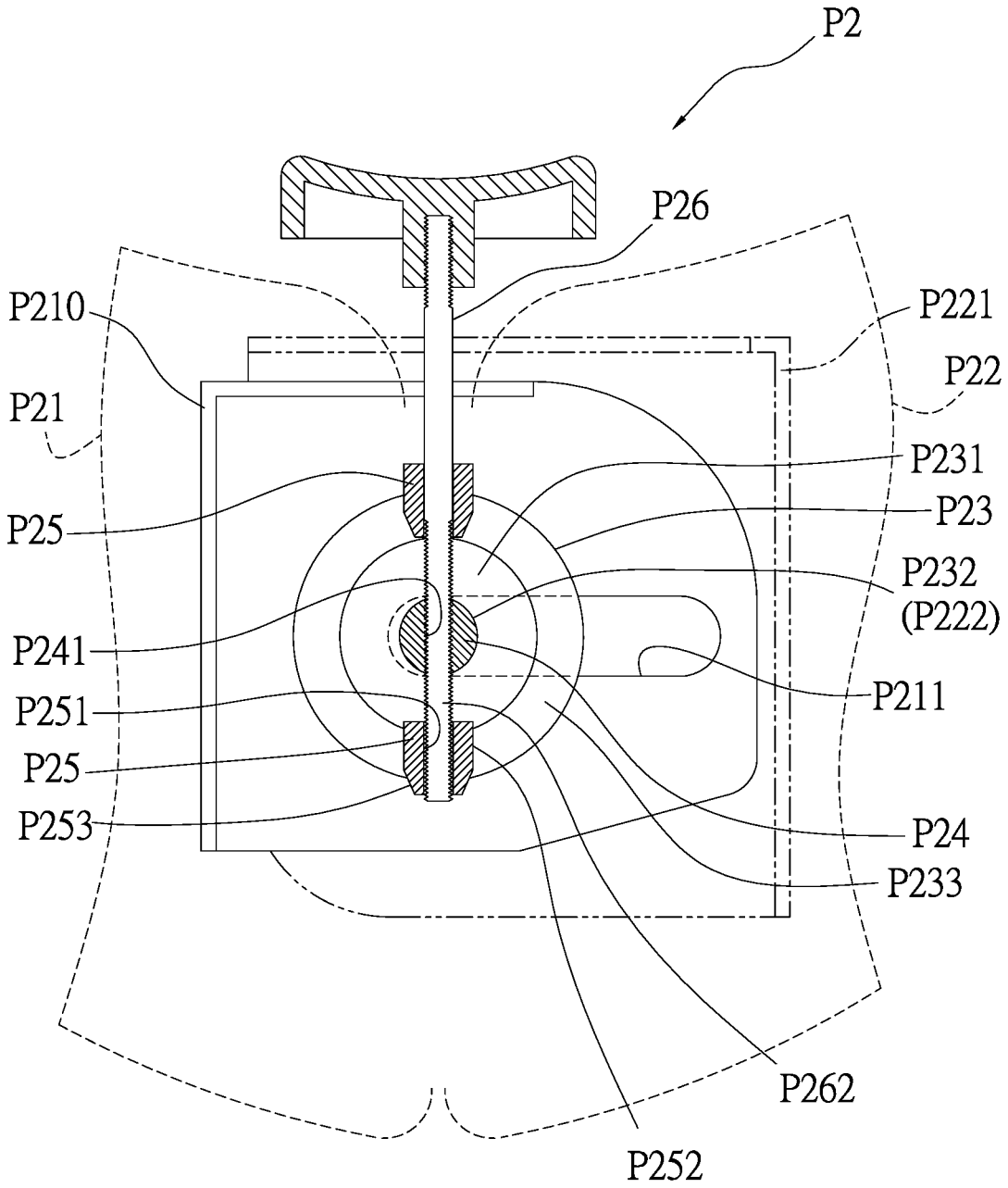
FIG. 3 PRIOR ART
FIG. 3 is another cross sectional view showing the assembly of the conventional saddle chair.

The present invention will be clearer from the following description when viewed together with the accompanying drawings, which show, for purpose of illustrations only, a preferred embodiment in accordance with the present invention.

With reference to FIGS. 4-7, a saddle chair 1 according to a preferred embodiment of the present invention at least comprises: a first seat 11 and a second seat 12.

The first seat 11 includes a first connection sheet 111 connected with a bottom of the first seat 11 and an elongated orifice 112 defined on the first connection sheet 111.

The second seat 12 includes a second connection sheet 121 connected with a bottom of the second seat 12 and a through orifice 122 defined on the second connection sheet 121.

A fixing member 2 is mounted on the first connection sheet 111, and the fixing member 2 includes a slide slot 21 defined on a top thereof and having a slidable face 211 formed on a bottom of the slide slot 21, a receiving orifice 22 defined on a center of the slidable face 211, and a chute 212 extending downward from the slidable face 211.

A drive member 3 is inserted through the receiving orifice 22, the elongated orifice 112, and the through orifice 122 to connect with a retainer 4 which is connected with a bottom of the second connection sheet 121.

The retainer 4 includes a contacting face 41 formed on a top thereof and contacting with the bottom of the second connection sheet 121.

Two screw bolts 5 are inserted through the retainer 4 upward to screw with a bottom of the drive member 3.

A control bolt 6 is screwed with a threaded orifice 31 of the drive member 3 and includes at least one recess 61 defined on the control bolt 6.

At least one engagement block 7 is fitted on the at least one recess 61 of the control bolt 6 respectively, and each of the at least one engagement block 7 includes a screw 71 inserted into each of the at least one recess 61 and received in the slide slot 21. Each engagement block 7 further includes a forcing edge 72 formed on a bottom thereof and sliding between the slidable face 211 and the chute 212, when the control bolt 6 is rotated to move along the threaded orifice 31, as shown in FIGS. 4-7.

The chute 212 corresponds to a front side of the drive member 3 and has a tilted face 213 defined on a front end of the chute 212 and extending reward to the receiving orifice 22. The control bolt 6 has two recesses 61 corresponding to the front side and a rear side of the drive member 3 respectively, and when two engagement blocks 7 are fitted into the two recesses 61 of the control bolt 6 individually, two pressing faces 73 on two bottoms of the two engagement blocks 7 are tilted respectively, i.e., two front sides of the two pressing faces 73 are higher than two rear sides of the two pressing faces 73 individually, and two forcing edges 72 are formed on the two rear sides of the two pressing faces 73 respectively, as illustrated in FIG. 4.

Figure 4:
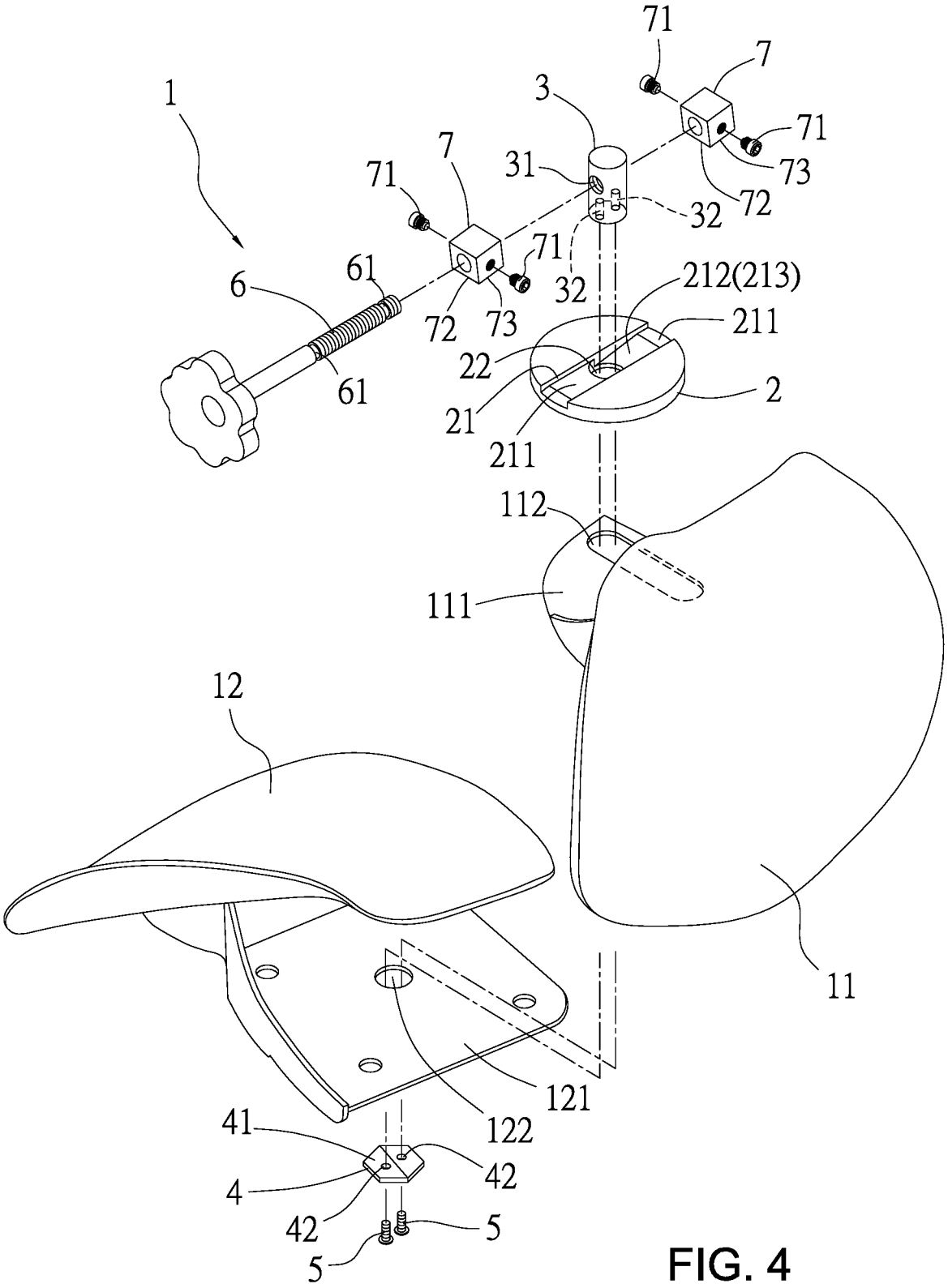
FIG. 4 is a perspective view showing the exploded components of the saddle chair according to a preferred embodiment of the present invention.

The drive member 3 further includes two threaded orifices 32 defined in a bottom thereof, and the retainer 4 further includes two coupling orifices 42 defined thereon and corresponding to the two threaded orifices 32 respectively, wherein the two screw bolts 5 are inserted through the coupling orifices 42 of the retainer 4 upward to screw with the two threaded orifices 32 of the drive member 3 respectively, thus fixing the retainer 4 on the bottom of the drive member 3, as shown in FIG. 4.

Figure 5:
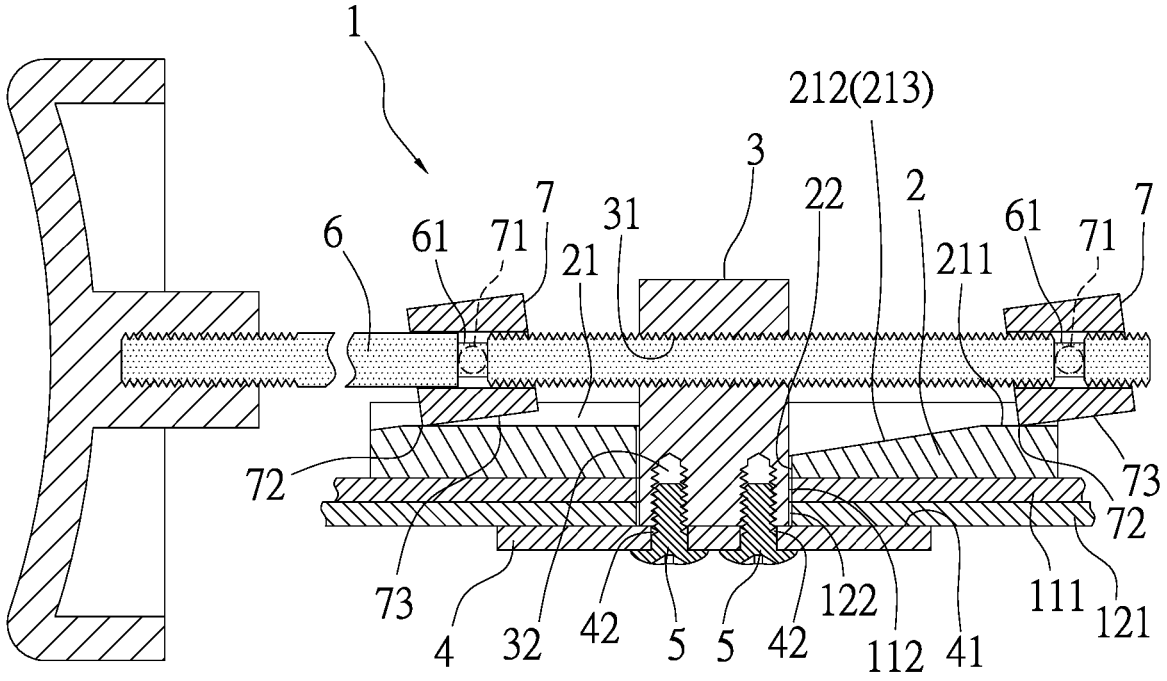
FIG. 5 is a cross sectional view showing the assembly of the saddle chair according to the preferred embodiment of the present invention.
Figure 6:
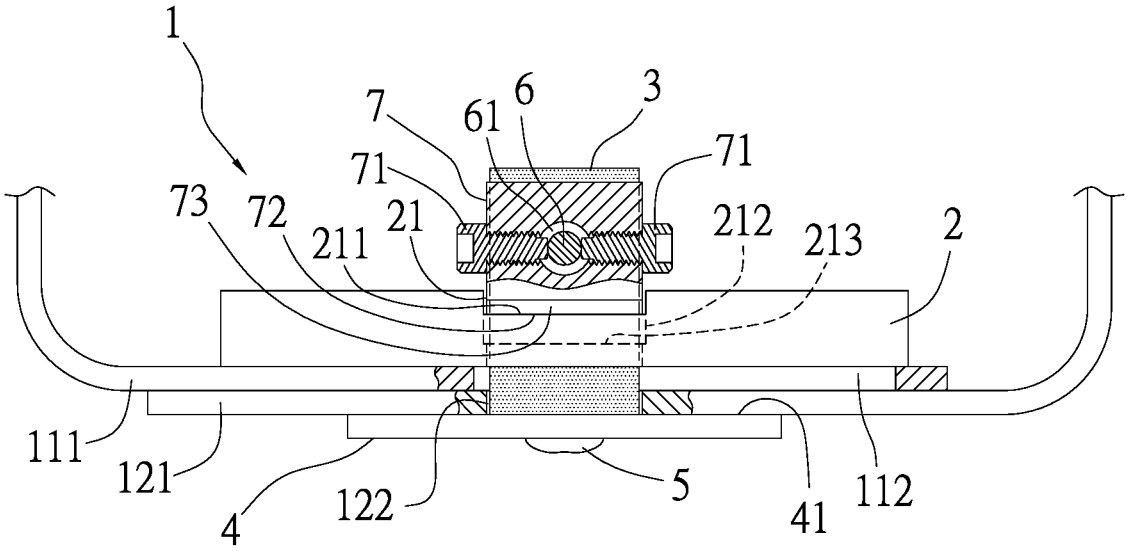
FIG. 6 is another cross sectional view showing the assembly of the saddle chair according to the preferred embodiment of the present invention.
Figure 7:
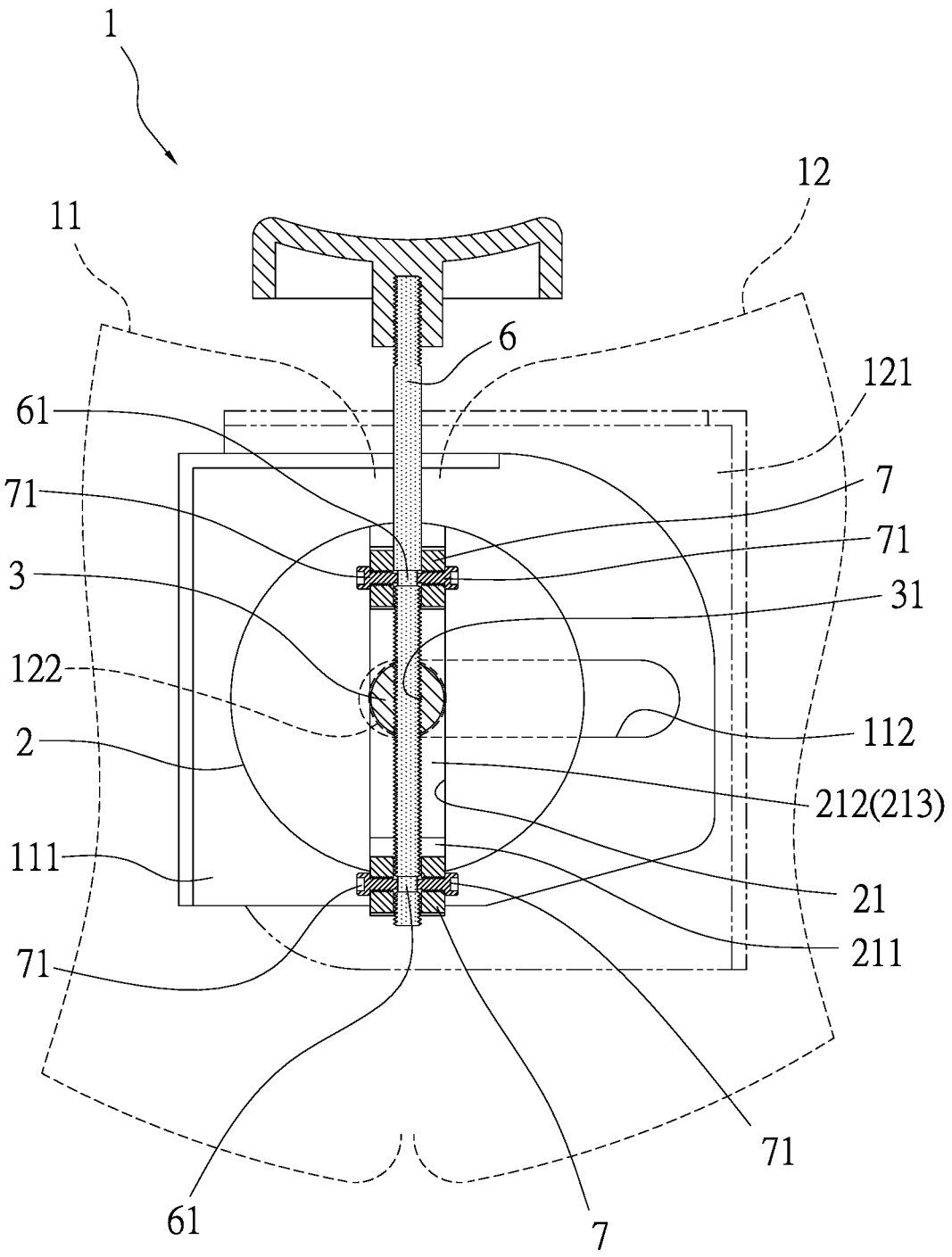
FIG. 7 is also another cross sectional view showing the assembly of the saddle chair according to the preferred embodiment of the present invention.

In operation, the control bolt 6 is applied to control the two engagement blocks 7 to slide forward or rearward along the slide slot 21, and the two forcing edges 72 force on the slidable face 211 to press the fixing member 2 to contact with the first connection sheet 111 by mating with the contacting face 41 of the retainer 4 and the second connection sheet 121, thus fixing the first seat 11 and the second seat 12, as shown in FIGS. 5-7.

Figure 8:
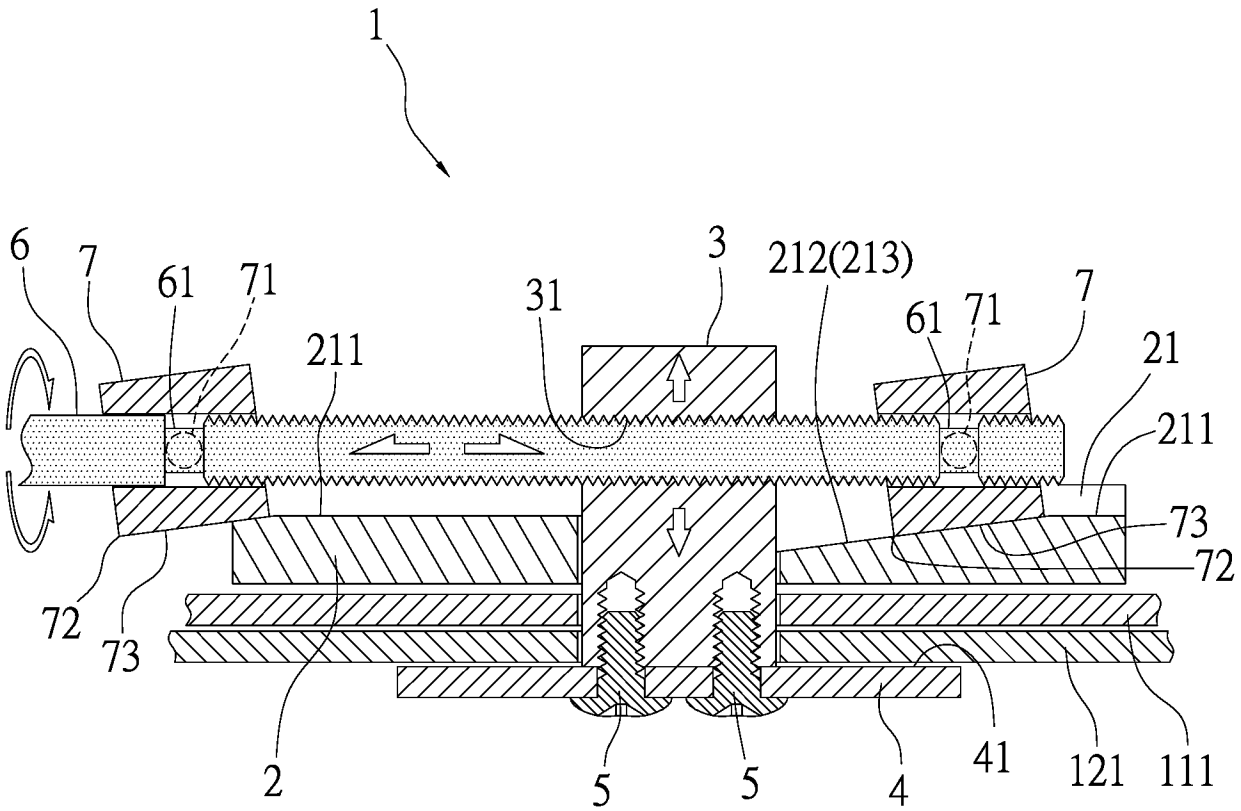
FIG. 8 is a cross sectional view showing the operation of the saddle chair according to the preferred embodiment of the present invention.
Figure 9:
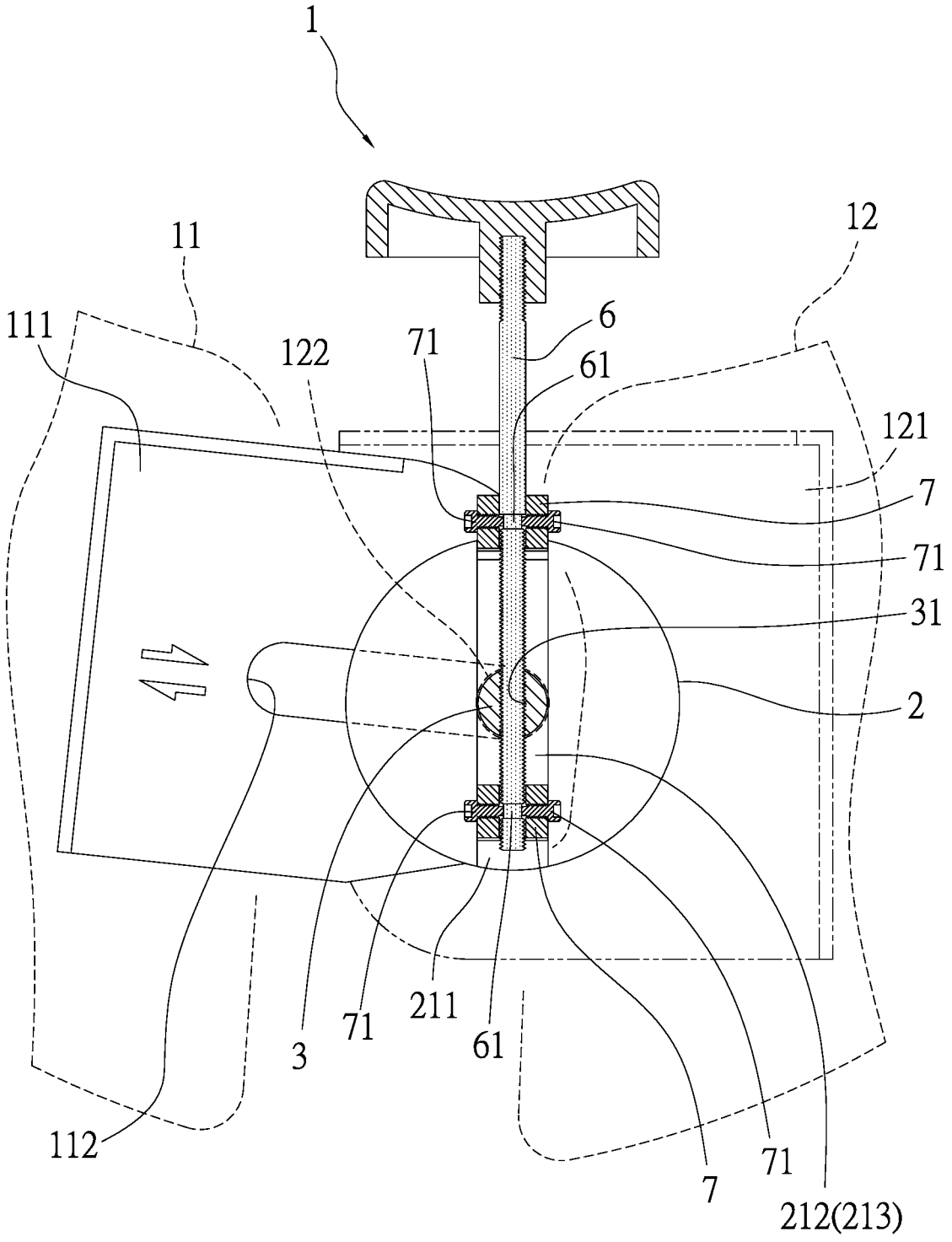
FIG. 9 is another cross sectional view showing the operation of the saddle chair according to the preferred embodiment of the present invention.

The control bolt 6 is rotated to control a front engagement block 7 of the two engagement blocks 7 to slide along the slide slot 21 so that the forcing edge 72 of the front engagement block 7 moves to the chute 212, and a rear engagement block 7 of the two engagement blocks 7 slides along the slide slot 21 so that the forcing edge 72 of the rear engagement block 7 removes from the chute 212 and the forcing edge 72 of the front engagement block 7 moves into the chute 212, hence a distance among the fixing member 2, the second connection sheet 121, and the retainer 4 is increased, thus releasing the first connection sheet 111. In the meantime, the first connection sheet 111 moves along the elongated orifice 112 to swing the first seat 11 to a desired position. Thereafter, the two forcing edges 72 of the two engagement blocks 7 are moved on the slidable face 211 so that the retainer 4 and the second connection sheet 121 are pulled upward to fix the first connection sheet 111, as illustrated in FIGS. 8 and 9. Referring to FIG. 8, the retainer 4 is pulled to retain the first connection sheet 111.

Thereby, the control bolt 6 controls the two engagement blocks 7 to move along the slide slot 21 so that the two forcing edges 72 are moved on the slidable face 211 to pull the retainer 4 upward, and the retainer 4 retains the first connection sheet 111. Alternatively, the control bolt 6 controls the two engagement blocks 7 to remove from the chute 212 along the slide slot 21 so as to increases the distance among the fixing member 2, the retainer 4, and the second connection sheet 121, thus releasing the first connection sheet 111 by moving the two engagement blocks 7 along the slide slot 21.

While various embodiments in accordance with the present invention have been shown and described, it is clear to those skilled in the art that further embodiments may be made without departing from the scope of the present invention.

What is claimed is:

1. A saddle chair at least comprising: a first seat and a second seat;

the first seat including a first connection sheet connected with a bottom of the first seat and an elongated orifice defined on the first connection sheet;

the second seat including a second connection sheet connected with a bottom of the second seat and a through orifice defined on the second connection sheet;

wherein a fixing member is mounted on the first connection sheet, and the fixing member includes a slide slot defined on a top thereof and having a slidable face formed on a bottom of the slide slot, a receiving orifice defined on a center of the slidable face, and a chute extending downward from the slidable face;

wherein a drive member is inserted through the receiving orifice, the elongated orifice and the through orifice to connect with a retainer which is connected with a bottom of the second connection sheet;

wherein the retainer includes a contacting face formed on a top thereof and contacting with the bottom of the second connection sheet;

wherein two screw bolts are inserted through the retainer upward to screw with a bottom of the drive member;

wherein a control bolt is screwed with a threaded orifice of the drive member and includes at least one recess defined on the control bolt;

wherein at least one engagement block is fitted on the at least one recess of the control bolt respectively, and each of the at least one engagement block includes a screw inserted into each of the at least one recess and received in the slide slot, wherein each engagement block further includes a forcing edge formed on a bottom thereof and sliding between the slidable face and the chute, when the control bolt is rotated to move along the threaded orifice.

2. The saddle chair as claimed in claim 1, wherein the chute corresponds to a front side of the drive member and has a tilted face defined on a front end of the chute and extending reward to the receiving orifice; the control bolt has two recesses corresponding to the front side and a rear side of the drive member respectively, and when two engagement blocks are fitted into the two recesses of the control bolt individually, two pressing faces on two bottoms of the two engagement blocks are tilted respectively, wherein two front sides of the two pressing faces are higher than two rear sides of the two pressing faces individually, and two forcing edges are formed on the two rear sides of the two pressing faces respectively.

3. The saddle chair as claimed in claim 1, wherein the drive member further includes two threaded orifices defined in a bottom thereof, and the retainer further includes two coupling orifices defined thereon and corresponding to the two threaded orifices respectively, wherein the two screw bolts are inserted through the coupling orifices of the retainer upward to screw with the two threaded orifices of the drive member respectively, thus fixing the retainer on the bottom of the drive member.

* * * * *